US006302410B1

(12) United States Patent
Wentworth et al.

(10) Patent No.: US 6,302,410 B1
(45) Date of Patent: Oct. 16, 2001

(54) ROD GRIPPING JAW

(75) Inventors: Steven W. Wentworth, Brookfield; Robert F. Crane, Oconomononoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/425,573

(22) Filed: Oct. 22, 1999

(51) Int. Cl.[7] ..... E21B 19/10; B25B 5/16

(52) U.S. Cl. ..... 279/152; 175/423; 269/268; 269/279; 269/283

(58) Field of Search ..... 175/423; 166/382; 294/102.2, 902; 279/123, 152; 269/268, 270, 271, 279, 283

(56) References Cited

U.S. PATENT DOCUMENTS

| | | | | |
|---|---|---|---|---|
| Re. 33,793 | | 1/1992 | Cherrington et al. | 175/61 |
| 2,552,618 | * | 5/1951 | Boatright | 175/423 |
| 3,975,045 | * | 8/1976 | Abarotin et al. | 294/902 |
| 4,592,682 | * | 6/1986 | Vanistendael | 279/123 |
| 4,953,638 | | 9/1990 | Dunn | 175/61 |
| 5,070,948 | | 12/1991 | Malzahn et al. | 175/19 |
| 5,253,721 | | 10/1993 | Lee | 175/73 |
| 5,778,991 | | 7/1998 | Runquist et al. | 175/61 |
| 5,799,740 | | 9/1998 | Stephenson et al. | 175/62 |
| 5,899,283 | | 5/1999 | Cox | 175/376 |

OTHER PUBLICATIONS

Vermeer Manufacturing Company Website, "Directional Boring Equipment," 1 page.

Earth Tool Company, D7×11A Navigator, Clamp Assembly Figure 9–2, 1997, 1 page.

Earth Tool Company, D7×11A Navigator, Rotation Cylinder Assembly Figure 9–5, 1997, 1 page.

Earth Tool Company, D7×11A Navigator, Clamp Cylinder Assembly Figure 9–6, 1997, 1 page.

* cited by examiner

*Primary Examiner*—Steven C. Bishop
(74) *Attorney, Agent, or Firm*—Philip G. Meyers; Intellectual Property Law, P.C

(57) ABSTRACT

An improved jaw for a rod gripping device is provided including a front, rod engaging face with a plurality of teeth or studs made of a material harder than the jaw body, such as tungsten carbide, with the studs positioned to engage an outer rounded rod surface. In one embodiment, the studs are oriented radially inward toward a longitudinal axis defined by the rod engaging surface. The rod engaging face of the jaw may have a concave shape in its lengthwise direction, thus being adapted to grasp a cylindrical member such as a rod or pipe section. A tool for gripping a rod including a pair of jaws is also provided.

14 Claims, 4 Drawing Sheets

ROD GRIPPING JAW

TECHNICAL FIELD OF THE INVENTION

The invention relates to an apparatus for grasping cylindrical bodies such as pipes and rods, in particular to a rod gripping jaw for use in directional boring.

BACKGROUND OF THE INVENTION

In order to meet the need for boring under or through obstructions such as roadways, concrete lined waterways and large underground utilities, systems for underground directional boring were developed. A directional borer generally includes a series of drill rods or pipe sections joined end to end to form a drill string. The drill rods or pipe sections are typically connected with threaded couplings. The drill string is pushed or pulled though the soil by means of a powerful hydraulic device such as a hydraulic cylinder. See Malzahn, U.S. Pat. Nos. 4,945,999 and 5,070,848, and Cherrington, U.S. Pat. No. 4,697,775 (RE 33,793). The drill string may be pushed and rotated at the same time as described in Dunn, U.S. Pat. No. 4,953,633 and Deken, et al., U.S. Pat. No. 5,242,026. A spade, bit or head configured for boring and steering is disposed at the end of the drill string and may include an ejection nozzle for water to assist in boring.

The pipe sections used in drill strings are typically steel pipe having a diameter of from about one to eight inches, more often four to eight inches. During drilling, rod or pipe sections are added as the bore is advanced and removed when the tool is retracted for replacement or repair. Thus, as the pipe or rod is being advanced, it is necessary to couple and tighten additional sections of pipe to the drill string. Conversely, when the drill string is removed from the bore, it is necessary to loosen and decouple adjacent pipe sections.

Making and breaking joints between adjacent pipe sections in a drill string is generally accomplished with a hydraulic vise that having two adjacent pairs of jaws that grip adjacent sections of pipe and rotate the front section to engage or disengage a threaded pipe coupling. Such coupling and decoupling apparatus is known in the art. The rod gripping jaws should securely grasp of the pipe section without applying enough force to crush it or damage its surface.

Conventional pipe or rod gripping jaws are typically fabricated from steel or a steel alloy and have knurled surfaces to aid in grasping the pipe section. However, the effective life of conventional steel jaws for use in directional boring machines is limited. While the use of steel projections or knurled surfaces on rod gripping jaws may aid in gripping the surface of a steel pipe section, the steel-on-steel gripping action rapidly wears the gripping surfaces of the jaw. Thus, there exists a need for an improved rod gripping jaw, and in particular, an improved rod gripping jaw adaptable for use in connection with directional boring machines.

SUMMARY OF THE INVENTION

The invention provides an improved jaw for gripping a cylindrical object such as a drill rod used in a directional boring machine. The body of each jaw has a front face on which a plurality of teeth or studs are mounted. These teeth are made of a material harder than the jaw body and are positioned to engage an outer rounded rod surface. The improved jaw of the invention is particularly suitable for use in connection with directional earth boring machines which must grasp, couple and decouple section of drill string during the drilling operation. The teeth are preferably arranged in an array or formation that permits the teeth to grip a semi-cylindrical portion of a rod or pipe surface evenly, and the number of teeth is such that each tooth tip digs into the outer surface of the pipe or rod a sufficient depth to securely hold the rod, but not so deeply that the rod surface is scored excessively. In one embodiment, the teeth are oriented radially inwardly toward a longitudinal axis defined by a lengthwise concave recess in the front face of the jaw.

In another aspect, a tool for gripping a rod including a pair of jaws is provided. Each of the jaws comprises a steel jaw body with a concave surface in its lengthwise direction, thereby being adapted to engage a curved surface. Each of the jaws is provided with a plurality of studs having conical tips with points configured to penetrate and grip an outer surface of a curved cylindrical steel member. The studs are made of a material harder than the jaw body and configured to project from the jaw to provide a clearance between the concave surface of the jaw and the outer surface of the curved cylindrical member upon engagement of a rod or similar body.

A clamp assembly according to the invention configured for use in a directional boring machine includes a U-shaped clamp having a pair of first and second arms. A movable stem jaw is mountable against an inside wall of the first arm, and a vise jaw which may be movable or fixed is mountable against an inside wall of the second arm in a position opposed to the movable jaw. Suitable means may then be provided for securing the vise jaw in position against the inner wall of the second arm. Similarly, means such as a annular flange welded to the rear face of the stem jaw extends through an opening in the first arm for movably supporting the stem jaw for movement towards and away from the vise jaw. The vise and stem jaws are each provided with teeth or studs according to the invention as described above.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
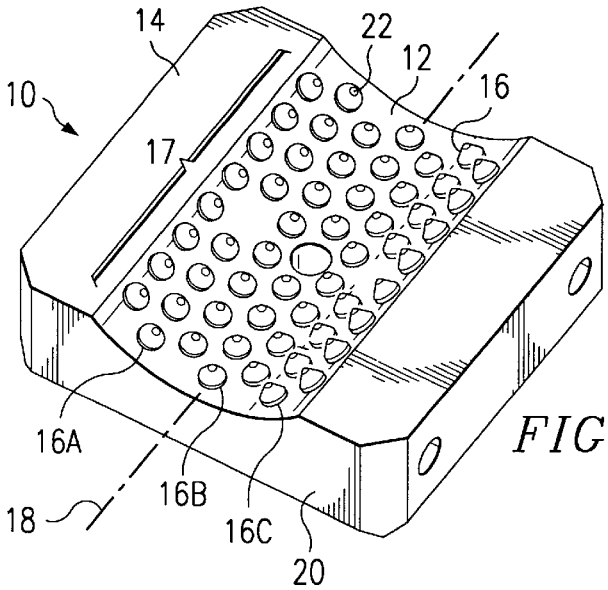
FIG. 1 is a top perspective view of a rod-gripping jaw including a concave face with a plurality of studs for grasping and engaging a cylindrical member such as a rod or pipe section.
Figure 2A:
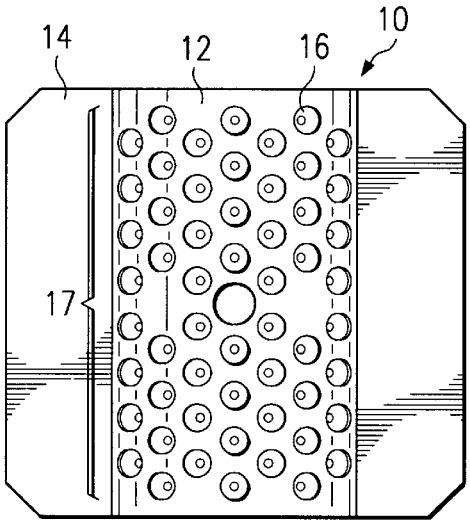
FIGS. 2A–2E are top, front end, rear end, right side and left side views of the jaw of FIG. 1, respectively.
Figure 2C:
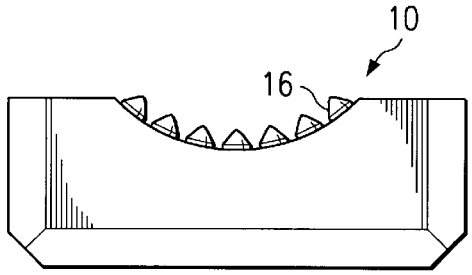
Figure 2B:
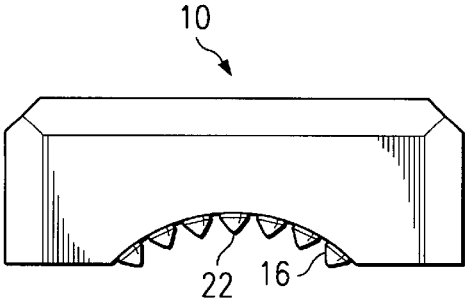
Figure 2D:
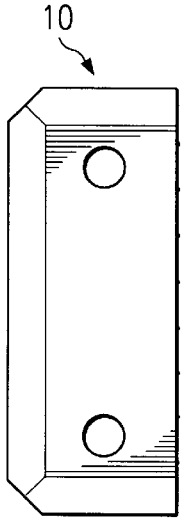
Figure 2E:
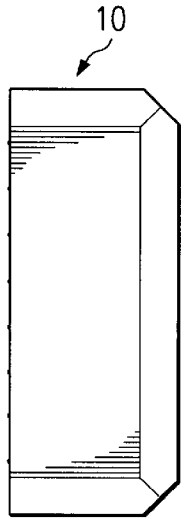

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

Referring now to FIGS. 1 and 2A–2E, in one embodiment, a rod-gripping jaw 10 of the invention includes a generally rectangular block or jaw body 20 having a longitudinally extending, concave recess 12 in one rectangular side face 14. Recess 12 is curved in its widthwise direction and may have a circular (arcuate) or non-circular profile in cross section. A number of studs or teeth 16 are embedded in or set onto recess 12. Studs 16 which are set into holes in the jaw body are preferred over teeth which are merely welded or otherwise attached to the surface thereof. Such studs 16 are arranged in one or more longitudinal rows 17 generally aligned with a longitudinal axis 18 of jaw 10.

Each stud 16 has a tip 22 produced from a material harder than the material from which body 20 and/or the rod to be held is formed. In a preferred embodiment, each stud 16 is a unitary pellet made of a hard, wear resistant material which is not excessively brittle and has a hardness greater than a conventional 4140 steel alloy, for example, high carbon tool steel, diamond, or a ceramic such as tungsten carbide. If stud 16 includes a tip 22 as a separate insert, the stud also includes a cylindrical holder made from a conventional steel such as 4140 alloy, and only the tip is made of the hardened material as described. However, since each stud 16 is relatively small, use of a unitary pellet is most preferred. Studs 16 may also comprise steel or ceramic inserts which have been surface coated on at least tip 22, as by sintering and other methods known in the art, with a thin layer of hard material such as diamond.

As illustrated in FIG. 1, studs 16 are preferably of uniform size, and are distributed in a generally uniform manner on the surface of recess 12. Depending upon the application, studs of different sizes or shapes may be used in a single jaw, or the studs may be positioned in a non-uniform manner on the jaw. As illustrated, approximately fifty-six studs 16 (seven rows of eight studs each) are shown distributed over concave recess 12. Typically between three (e.g., 1 row of 3) to one hundred (e.g., 10 rows of 10) studs will be distributed in parallel rows 17. Studs 16 in adjoining rows 17 are staggered as shown so that spacing between studs 16 is uniform, or approximately so. Rows 17 are located on the recess 22 to form an array or formation of studs 16 that can grip a circular rod evenly and leave a clearance between the surface of recess 12 and the rod surface. If the cross-sectional profile of recess 12 is circular or parabolic, it is preferred to have each row 17 of studs 16 substantially perpendicular to the adjoining surface in which it is mounted, so that lengthwise axes of studs 16 at the same cross section intersect at a common point or focus F, for example studs 16A, 16B and 16C in FIGS. 1 and 3.

A greater or lesser number of studs can be used depending upon the diameter of the rods to be engaged, the torque required to unscrew them, and similar considerations. The usual minimum is at least one perpendicular bottom stud and at least two side studs inclined in opposite directions relative to the bottom stud, for example, from about 10–60 degrees, wherein the angle is most preferably the same for each pair of studs in the same longitudinal row 17 or in symmetrical positions on opposite sides of jaw axis 18. For example, in a minimal configuration, three studs 16 could be used, including an upright bottom stud, a first side stud left of the bottom stud and inclined right by an angle in the range of 30°–60°, 45 degrees as shown, and a second side stud right of the bottom stud inclined left by an angle in the range of 30°–60°. In an expanded configuration with at least three rows 17, all of the studs in the same row 17 (e.g., as studs 16A, 16B, 16C respectively) are preferably angled in the same direction.

Figure 3:
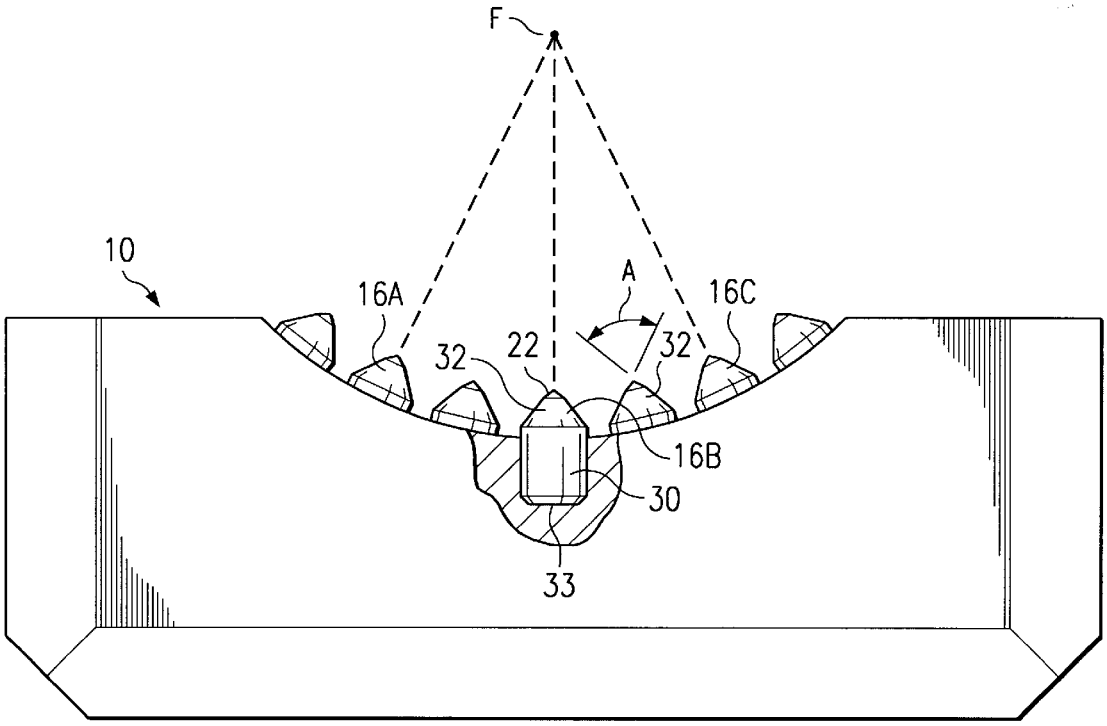
FIG. 3 is an enlarged view of FIG. 2C, partly in section.

Referring to FIG. 3, stud 16 is bullet-shaped with a cylindrical bottom portion 30 and a conical upper portion 32 that tapers to point 22. Each stud 16 may be press-fitted into a blind hole 33 in jaw body 12 and/or secured therein by known processes such as copper brazing. Conical portion 32 and tip 22 are exposed after the to stud is fully inserted into hole 30. Preferably, conical upper portion 32 is formed at an included angle A of from about 30° to 120°, preferably 40° to 90°, centered on the stud axis. Tip 22 is preferably sufficiently small and pointed that it "bites" or penetrates a small distance into the outer surface of a rod or pipe section without excessive penetration that might deform or damage the rod or pipe section. Carbides with hemispherical or substantially hemispherical heads as used on rock drills to protect the bit from abrasion are not preferred for applications of the present invention wherein a high torque must be exerted, such as when uncoupling directional drill rods.

Figure 4:
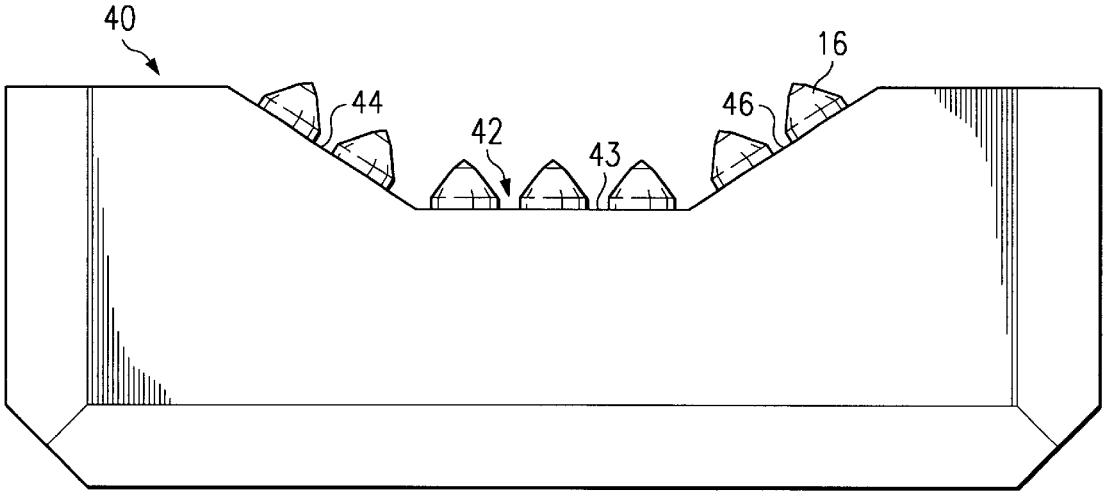
FIG. 4 is an end view similar to FIG. 3 of an alternative jaw according to the invention.
Figure 5:
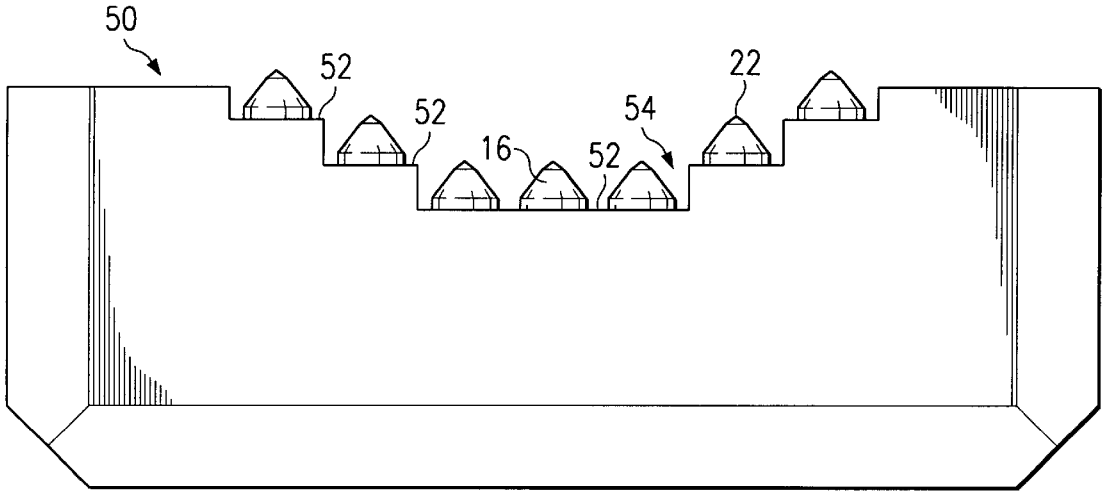
FIG. 5 is an end view similar to FIG. 3 of another alternative jaw according to the invention.

FIG. 4 illustrates a modified jaw 40 of the invention wherein the concave profile of FIGS. 1–3 is replaced by an outwardly flaring, trough-shaped recess 42 having a flat bottom 43 and a pair of straight, angled side walls 44, 46 that angle outwardly at angle generally from 30°–60° to approximate a concave curvature. FIG. 5 shows a stepped embodiment of a jaw 50 wherein the studs 16 are mounted in parallel on a series of parallel, offset flat walls 52. Differences in stud lengths and/or the depth of stepped recess 54 could be used so that tips 22 approximate an arc comparable to the shape of the outer surface of the rod or pipe to be engaged. Similarly, it is even possible (though uneconomical) to eliminate the recess altogether and use teeth or studs of varying lengths to define an arc with tips 22. Modifications of this sort are within the scope of the invention.

Figure 6:
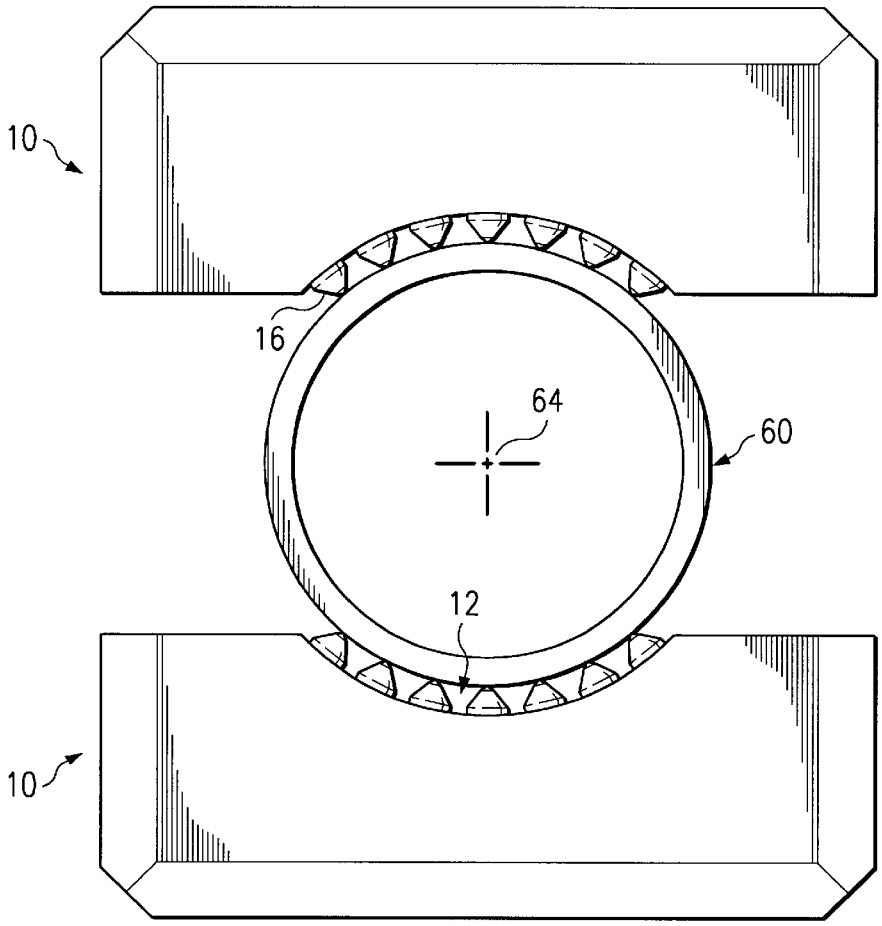
FIG. 6 is an end view, partly in section, of a rod gripping tool utilizing jaws of the invention.

FIG. 6 illustrates a pair of rod-gripping jaws 10 of the invention clamped onto a rod section 60. Jaws 10 clamp pipe section 60 by means of any suitable actuator, such as a hydraulic cylinder, with sufficient force to enable the studs 16 to bite into the surface of the rod 60. As illustrated studs, 16 are oriented radially inwardly toward a centrally disposed longitudinal axis 64 of pipe section 60 that is parallel to the axes 18 of each jaw 10. Although two jaws 10 are shown, more than two jaws could be used, for example, four jaws at 90 degree angles set in two pairs.

Figure 7:
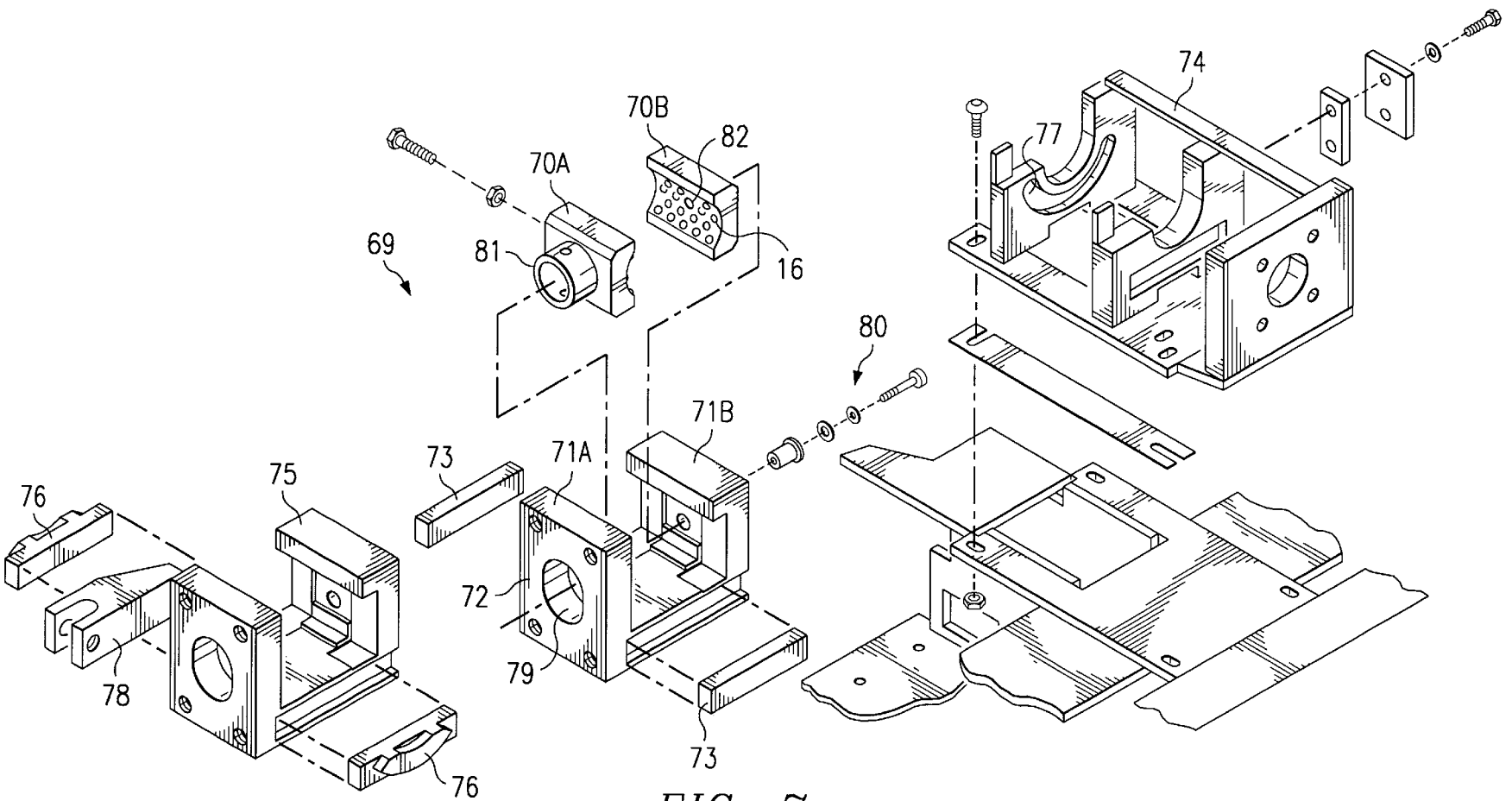
FIG. 7 is an exploded view of a clamp assembly according to the invention.

FIG. 7 illustrates a clamp assembly 69 according to the invention for use in a directional boring machine. Clamp mechanism has a stem jaw 70A and a vise jaw 70B having studs 16 according to the invention. Jaws 70A, 70B are configured for mounting in opposing positions on inner surfaces of arms 71A, 71B of a U-shaped lower or rear clamp 72. Rear clamp 72 is in turn mounted by bar slides 73 into a clamp frame 74. An upper or front clamp 75 can pivot by means of a pair of pivot slides 76 mounted in grooves 77 of frame 74. A hole 79 provided on arm 71 A permits connection of an annular flange 81 extending from a rear face of jaw 70A to a conventional clamp cylinder assembly, not shown, which extends and retracts stem jaw 70A. Vise jaw 70B is preferably removably held in a fixed position by any suitable means, such as a bolt assembly 80 which engages a central threaded hole 82 in jaw 70B. A like mechanism is provided for front clamp 75.

Front clamp 75, which mounts another pair of jaws 70A, 70B (not shown), has an arm 78 which mounts an axle that is rotatably connected to a conventional hydraulic cylinder assembly which is engaged to pivot rear clamp 75 on slides 76 while front clamp 72 remains in place to unscrew one drill rod section from another. Such a clamp assembly of the invention is suitable for use in gripping drill string rods used by a directional boring machine, such as one of the Vermeer Navigator line. In addition, jaws of the invention can also be used in non-steering pipe pulling and pushing machines which operate using drill strings.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. A jaw for a device for gripping a cylindrical object comprising:

a jaw body having a recessed front face, the front face comprising a plurality of spaced apart cylindrical apertures, the cylindrical apertures comprising blind holes configured for receiving a plurality of studs;

a plurality of studs, each of which being positioned in one of the apertures, each of the studs having a cylindrical bottom portion and a conical upper portion formed at an included angle of from about 30° about 120° centered on the stud axis to form a tip for engaging a cylindrical object, each of the tips being formed from a material having a hardness greater than the jaw body and sufficiently hard to penetrate and grip the outer surface of a cylindrical steel pipe.

2. The jaw of claim 1, wherein the jaw body comprises steel and the front face has a concave recess extending in its lengthwise direction spanning opposite edges of the front face, and the studs are carbide studs disposed on a surface of the recess.

3. The jaw of claim 1, wherein the studs are angled radially inward toward an imaginary longitudinal axis defined by the concave recess.

4. The jaw of claim 1, wherein the studs are distributed in spaced positions on the front face, forming a formation of studs which can grip the cylindrical object evenly and leave a clearance between the outer surface of the cylindrical object and the front face of the jaw.

5. The jaw of claim 4, wherein the formation of studs comprises a plurality of rows and wherein each row extends in a lengthwise direction of the jaw, and the studs of each row are staggered relative to the studs of the each adjacent row.

6. The jaw of claim 5, wherein the tips of the studs are arranged in a generally arcuate formation.

7. An apparatus for gripping a cylindrical steel object, comprising:

a pair of opposing jaw bodies each having a front face with a recess extending in its lengthwise direction spanning opposite edges of the front face, the recess having a uniform concave shape along its length, each of the opposed front faces comprising a plurality of spaced apart cylindrical apertures, each of the cylindrical apertures comprising a blind holes for receiving a stud;

a plurality of studs, each of which being positioned in one of the apertures, each of the studs having a cylindrical bottom portion and a conical upper portion formed at an included angle of from about 30° about 60° centered on the stud axis to form a tip for engaging a cylindrical object, each of the tips being formed from a material having a hardness greater than the jaw body and sufficiently hard to penetrate and grip the outer surface of a cylindrical steel pipe.

8. The apparatus of claim 7, wherein the studs of each face are angled radially inwardly toward an imaginary longitudinal axis defined by each of the concave recesses.

9. The apparatus of claim 8 wherein the studs are arranged on each face in a plurality of lengthwise rows and where each the studs of each row are staggered from the studs of adjacent rows, the row of studs forming a formation which can grip the cylindrical object evenly and leave a clearance between the outer surface of the cylindrical object and the front face of the jaw.

10. The apparatus of claim 9 comprising at least three rows of studs, including a row of upright bottom studs positioned along the lengthwise axis of the recess, a first row of side studs left of the row of bottom studs and inclined right by an angle in the range of about 30–60 degrees, and a second row of side studs right of the row of bottom studs and inclined left by about 30–60 degrees.

11. A clamp assembly configured for use in a directional boring machine, comprising:

a U-shaped clamp having a pair of first and second arms;

a movable stem jaw mountable against an inside wall of the first arm;

a vise jaw mountable against an inside wall of the second arm in a position opposed to the first moveable jaw;

the stem jaw and the vise jaw each comprising a jaw body having a concave front face, the front face comprising a plurality of spaced apart cylindrical apertures, the cylindrical apertures comprising blind holes for receiving a plurality of studs;

a plurality of studs, each of which being positioned in one of the apertures, each of the studs having a cylindrical bottom portion and a conical upper portion formed at an included angle of from about 30° about 60° centered on the stud axis to form a tip for engaging a cylindrical object, each of the tips being formed from a material having a hardness greater than the jaw body and sufficiently hard to penetrate and grip the outer surface of a cylindrical steel pipe.

12. The clamp of claim 11, wherein the vise jaw is secured in a fixed position against the inner wall of the second arm; and the stem jaw is mounted for movement towards and away from the vise jaw.

13. The clamp of claim 12 further comprising a bolt assembly for securing the vise jaw.

14. The assembly of claim 11, further comprising an annular flange on a rear face of the stem jaw, which flange extends rearwardly through the opening in the first arm, the annular flange supporting the stem jaw.

* * * * *